US006793327B2

(12) United States Patent
Huliba

(10) Patent No.: US 6,793,327 B2
(45) Date of Patent: Sep. 21, 2004

(54) LOW CATCH VOLTAGE STARTUP

(75) Inventor: David A. Huliba, Centerville, OH (US)

(73) Assignee: Eastman Kodak Company, Rochester, NY (US)

( * ) Notice: Subject to any disclaimer, the term of this patent is extended or adjusted under 35 U.S.C. 154(b) by 46 days.

(21) Appl. No.: 10/254,354

(22) Filed: Sep. 25, 2002

(65) Prior Publication Data

US 2004/0056933 A1 Mar. 25, 2004

(51) Int. Cl.[7] ..... B41J 2/085
(52) U.S. Cl. ..... 347/73; 347/90
(58) Field of Search ..... 347/73, 76, 77, 347/82, 90, 36; 397/74

(56) References Cited

U.S. PATENT DOCUMENTS 5,475,411 A * 12/1995 Strain et al. ..... 347/90

* cited by examiner

*Primary Examiner*—Lamson D Nguyen
(74) *Attorney, Agent, or Firm*—Barbara Jean Haushalter

(57) ABSTRACT

The use of the lowest all catch voltage for deflecting the charged droplets onto the catcher surface enhances the reliability of the startup sequence for ink jet printers. Going from a state where all of the droplets are hitting in the eyelid seal and catch pan assembly to a state where all of the droplets are deflected and caught on the catcher face will help eliminate the possibility of splatter on the charge plate electrodes and/or the charge short detect level circuitry, ink on top of the eyelid seal, and wicking of ink out of the eyelid.

20 Claims, 2 Drawing Sheets

LOW CATCH VOLTAGE STARTUP

TECHNICAL FIELD

The present invention relates to continuous ink jet printing and, more particularly, to a startup sequence for transitioning directionality of the fluid droplets from a state of no charge potential to a state of full charge potential.

BACKGROUND ART

Ink jet printing systems are known in which a printhead defines one or more rows of orifices which receive an electrically conductive recording fluid from a pressurized fluid supply manifold and eject the fluid in rows of parallel streams. Printers using such printheads accomplish graphic reproduction by selectively charging and deflecting the drops in each of the streams and depositing at least some of the drops on a print receiving medium, while others of the drops strike a drop catcher device.

During the automatic startup sequence of a continuous ink jet printhead, the ink jets under pressure are stimulated to form uniform droplets that fall past the charge plate and catcher, but are caught in the sealing area of the eyelid seal and catch pan assembly and then are ingested into the catcher throat and returned to the fluid system by vacuum. In one of the many steps that define the startup sequence for continuous inkjet printers, the formed droplets suddenly have a charge potential applied when the printer is started, such that the directionality of the droplets are changed from hitting at the eyelid seal and catcher throat interface and pulled by vacuum into the catcher throat for return to the fluid system, to being deflected upon the face of the catcher for vacuum return to the same.

Prior startup sequences have used the "best" print window voltage, minus a fixed number, to establish the first charge potential to change the droplet directionality. The charge potential was then subsequently stepped until the "best" print voltage was reached. In prior art systems, the purpose of this lowered first charge potential relative to the "best" print voltage was to minimize possible voltage overshoot that might over-deflect the drops and cause a charge plate short problem. In such prior art systems, it is necessary to have the first charge potential only a small amount below the best print voltage to eliminate voltage overshoot induced charge plate shorting.

In recent long array, high resolution printheads such as the VersaMark printheads, manufactured and sold by Scitex Digital Printing, Inc., in Dayton, Ohio, it has been found that it is desirable to lower the first charge potential a greater amount relative to the "best" print voltage. With a fixed voltage difference between the "best" print voltage and the first charge potential, it has been found that while many printheads can startup properly, certain printheads have high failure rates at startup. If the voltage difference is not large enough, the drop deflection overshoot for some printheads can produce charge plate shorts. Conversely if the voltage difference is too large, the first charge potential for some printheads may not change the deflection path enough to cause all of the droplets to hit on the catcher face. The droplets that do not hit upon the catcher face have the adverse ability to cause splatter on the charging electrodes that could interfere with the print droplets or the charge short detection circuit leading to a charge short, flow up the eyelid seal where a path to ground can be formed with the orifice plate leading to a charge short, or wick out of the eyelid seal leading to dripping. As the flow rate and pressure for printheads increases, the severity of the above mentioned problems can potentially lead to poor startup reliability, unless all of the droplets are deflected to hit the catcher resulting in a smoother fluidic transition.

It would be desirable, therefore, to be able to transition directionality of all of the fluid droplets, using the "lowest all catch" voltage, where the lowest all catch voltage is defined as the lowest charge potential where all of the droplets hit the catcher face.

SUMMARY OF THE INVENTION

This need is met by the startup sequence according to the present invention, wherein a sequence in the startup cycle of the printhead deflects ink droplets into catch using a predetermined lowest all catch voltage. Since the lowest all catch voltage is determined during the manufacture of the printhead and can be stored in the printhead memory chip, the method of the present invention improves the startup reliability and eliminates the potential for the above-mentioned problems.

In accordance with one aspect of the present invention, the use of the lowest all catch voltage for deflecting the charged droplets onto the catcher surface enhances the reliability of the startup sequence, particularly as printheads are developed having higher speed and flow rate of droplets. By going from a state where all of the droplets are hitting in the eyelid seal and catch pan assembly to a state where all of the droplets are deflected and caught on the catcher face will help eliminate the possibility of splatter on the charge plate electrodes and/or the charge short detect level circuitry, ink on top of the eyelid seal, and wicking of ink out of the eyelid.

Other objects and advantages of the invention will be apparent from the following description, the accompanying drawings and the appended claims.

DETAILED DESCRIPTION OF THE PREFERRED EMBODIMENTS

Prior to startup, continuous inkjet printers have fluid droplets having a state of no charge potential. In this state, the fluid droplets flow in the direction illustrated in FIG. 1. At some point in the startup sequence, the droplets will have a charge potential applied such that their directionality changes from hitting at the bottom of the catcher (interface of the eyelid seal and catch pan assembly) to being caught on the catcher surface depending upon the level of charge. This is illustrated in FIG. 2. However, if the level of charge is too low, not all of the droplets will be deflected onto the catcher face. Conversely, if the charge is too high, the droplets could be deflected into the charge plate and/or short detect level circuitry, causing a charge short.

Figure 1:
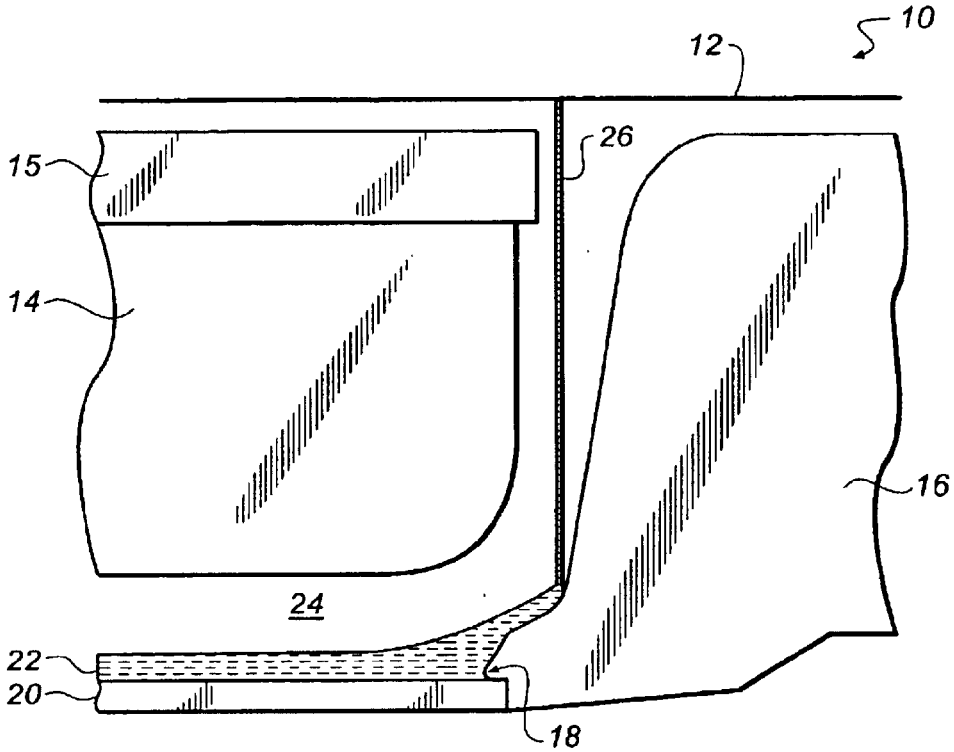
FIG. 1 (PRIOR ART)
FIG. 1 is a prior art illustration of a flow direction of fluid droplets having no charge potential (i.e., no deflection) in a printhead of a continuous ink jet printing system.
Figure 2:
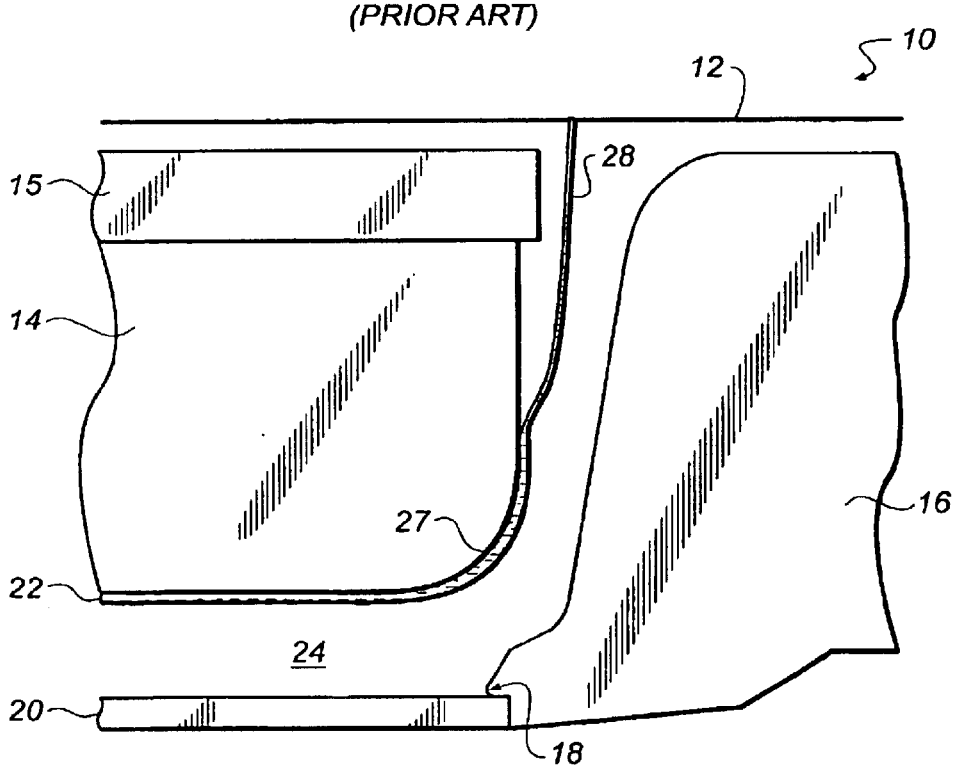
FIG. 2 (PRIOR ART)
FIG. 2 is a prior art illustration of the flow direction of fluid droplets having full charge potential (i.e., being deflected into catch) in a printhead of a continuous ink jet printing system.

Continuing with FIGS. 1 and 2, there is illustrated a prior art view of a drop generator and catcher assembly 10. A drop generator 12 is situated in an area above a catcher 14 and charge plate 15, and an eyelid 16. When the eyelid is in the open position, ink drops are allowed to exit the printhead. When the eyelid is moved to the closed position, as shown in FIG. 1, the eyelid seal 18 presses against the bottom edge of the catcher plate 20 to contain ink 22 within the printhead on startup and shutdown of the printer system. The uncharged ink droplets flow along a trajectory path indicated by 26 in FIG. 1. The ink striking the eyelid 16 is diverted by the eyelid into the fluid channel 24 of the of the catcher. This ink flow through the fluid channel is primarily along the lower surface of the fluid channel, defined by the catcher plate 20.

Upon startup, the ink drops become charged, changing the trajectory path of the droplets as indicated by 28 in FIG. 2. The ink drops strike the face of the catcher 14 and flow down the face of the catcher, around the catcher radius 27, and into the fluid channel 24 of the catcher. The fluid flow through the fluid channel under these conditions is primarily along the upper surface of the fluid channel, defined by the surface of the catcher.

During a startup sequence, it is desirable to employ a heater to heat up the charge plate and catcher of the ink jet printhead. Heating the charge plate and catcher while printing is known to eliminate condensation on the charge plate and catcher face that can lead to printhead failures. In a startup sequence, one state can cause condensation to form on the charging electrodes. The condensate serves to dissolve and rinse away ink residue from the charging electrodes to prevent charge plate shorts. After the condensate has appropriately rinsed the charging electrodes, the charge plate and catcher are heated up to prevent further condensation from forming. The use of a heater attached to the charge plate and catcher effectively carries out these functions.

One effect of heating the charge plate and catcher in this manner is that the elevated temperature of the charge plate causes the charge plate to thermally expand. This expansion can cause the face of the charge plate to expand out toward the jet array. This outward expansion toward the jets has been found to be more significant on printheads with longer array lengths. It has been found that the ink flowing through the catcher serves as a heat sink for the heat supplied by the charge plate-catcher heater.

It has also been found that during the startup sequence, different startup states result in differing amounts of heat being removed from the charge plate catcher assembly. In particular, more heat can be removed by the ink flow through the catcher when the jet array is charged and deflected into catch than when the undeflected jet array strikes the eyelid seal and is diverted into the catcher throat. This difference in heat loss is unexpected as, in both conditions, all the ink is removed from the printhead via the catcher fluid flow channel. The enhanced heat flow from the catcher and charge plate which occurs when the jets are in catch, results in a drop in the temperature of the charge plate and catcher. As a result, the thermal expansion of the charge plate is reduced once the jet array is in catch.

In the operation of continuous inkjet printers, there is a minimum charge voltage required to deflect the ink drops in catch, denoted LAC for Lowest All Catch. In high resolution printheads, the switching on and off of the various charging electrodes, to select some drops for printing and others for being caught, necessitates an operating voltage (OpVolt) that can be significantly higher than that of the LAC voltage. At still higher charge voltages (called the CrashVoltage), the deflection of the charged drops can cause them to strike or crash into the charge electrodes, producing a printhead failure. While each printhead will have these three voltage conditions, it has been found that from printhead to printhead there is no fixed relationship between these three voltage conditions. That is, the voltage difference between the different voltage conditions, as well as the voltage ratio between these voltage conditions, vary significantly from printhead to printhead. This is illustrated in FIG. 3.

Figure 3:
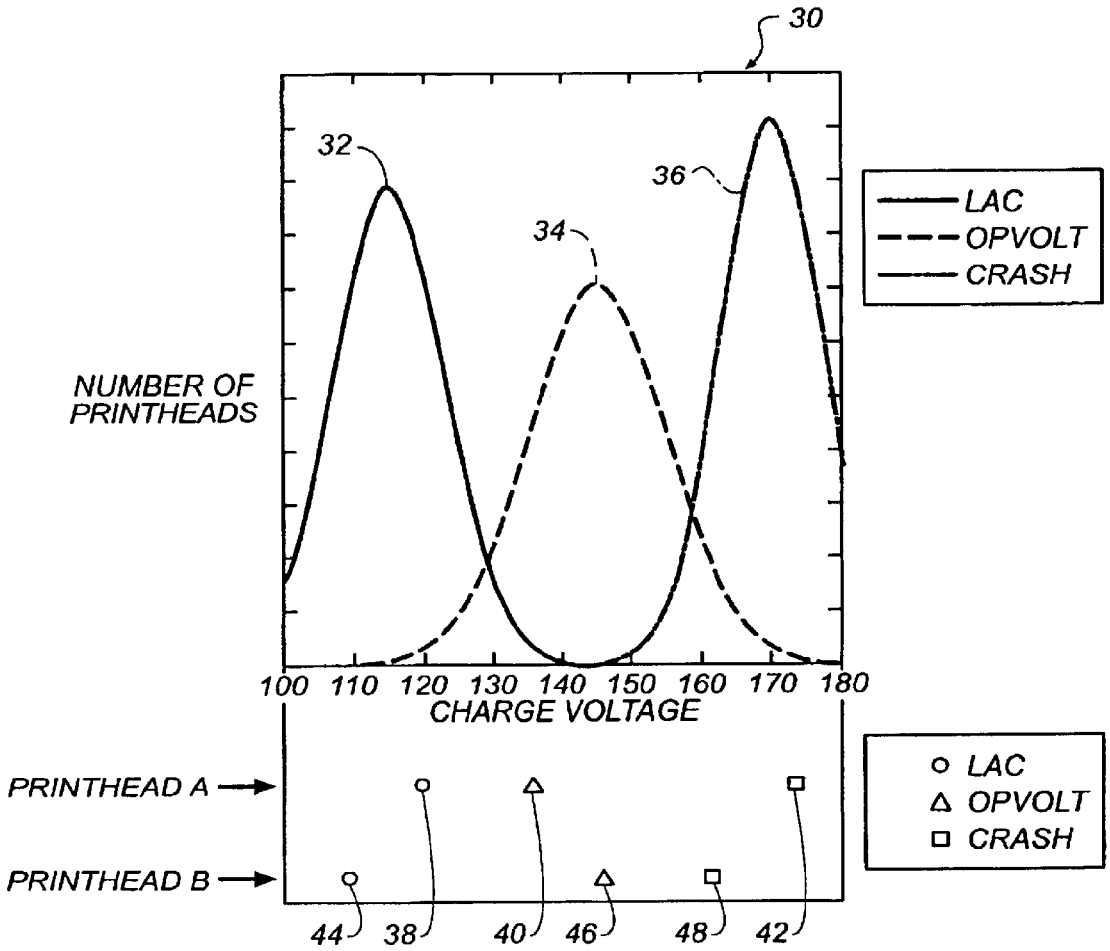
FIG. 3 is a histogram plot comparing printheads to voltage conditions.

In FIG. 3, the plot 30 illustrates the spread in these charge voltage conditions from printhead to printhead. The three curves 32, 34, and 36 correspond to the number of the printheads (vertical axis) having the horizontal axis charge voltage value as their LAC voltage, OPVolt and Crash voltages, respectively. As can be seen, there is some overlap of the charge voltage conditions. That is some printheads can have their OpVolt value lower than the LAC voltage for other printheads. Similarly, the Crash voltage of some printheads will be below the OPVoltage for other printheads.

The data points below the charge voltage scale in FIG. 3 show the charge voltage of two different printheads, A and B. The LAC voltage, OpVolt and Crash voltage for printhead A are shown at points 38, 40 and 42, respectively. For printhead B, the LAC voltage, OpVolt and Crash voltage are shown at points 44, 46 and 48, respectively. For printhead A the LAC voltage is about 120 volts and the OpVolt is about 135. Using the prior art methodology of having the startup charge voltage equal the OpVolt minus a value S, the value S would need to be approximately 15 volts or less to keep the startup voltage above the LAC voltage for that printhead. Using a startup shift voltage of S=15 volts, however, would result in a startup voltage for printhead B well above the LAC voltage for that printhead. Each of the charge voltage conditions depends on the spacing between the charging electrodes and the inkjets, with smaller spacings yielding smaller voltages for each of these conditions.

It has been found that the large thermal expansion of the charge plate that occurs during startup prior to placing the jet array in catch, as discussed above, causes each of these charge voltage conditions to initially be lower than their normal values. Of particular concern is the initial value of the Crash Voltage, denoted ICV. It has been found that for some printheads the ICV can be equal to or lower than the normal OPVolt. For such printheads, turning on the charge voltage directly to the normal OPVolt level, during the startup sequence, can result in charged drops crashing into the charging electrodes. This problem can be avoided by initially turning the charge voltage on to a lower charge voltage level. Once the jet array has gone into catch at this lower charge voltage, the heat loss from the charge plate and catcher is enhanced. After a small amount of time, the charge plate and catcher can cool sufficiently to reduce the thermal expansion back to its normal amount. The charge voltage can then be increased in one or more charge voltage steps to the normal OPVolt without problem.

As a result of this thermal expansion issue, as well as drop deflection overshoot due to conditions such as charge voltage overshoot, it is desirable to have the first charge potential well below the OpVolt. But as discussed previously, too low of a charge voltage can result in jets not going into catch, with the attendant problems. It is therefore necessary to ensure that the first charge potential be greater than or equal to the LAC for the printhead. Due to the large variability between the LAC and OpVolt from printhead to printhead, the ideal first charge potential is not well approximated by a fixed voltage shift down from the OPVolt condition.

In accordance with the present invention, it is proposed that the LAC voltage level be determined along with the OpVolt condition during printhead assembly or during regular operation of the printhead. These charge voltage conditions can then be stored in memory located either in the printer or the printhead. Then, in accordance with the present invention, the printer controller that manages the startup sequence uses the stored LAC value to define the first charge potential value. In a preferred embodiment, the controller would define the First Charge Voltage equal to the LAC voltage.

The use of the LAC voltage for deflecting the charged droplets onto the catcher surface enhances the reliability of the startup sequence for printheads having droplets of high speed and flow rate, contained within the narrow confines of the eyelid seal and catch pan assembly, for return to the fluid system under vacuum. By going from a state where all of the droplets are hitting in the eyelid seal and catch pan assembly to a state where all of the droplets are being deflected and caught on the catcher face, will help to eliminate the possibility of splatter on the charge plate electrodes and/or the charge short detect level circuitry, ink on top of the eyelid seal, and wicking of ink out of the eyelid.

While the embodiment above is preferred, for some printhead configurations, different algorithms for defining the first catch voltage may be advantageous. For example, when an inkjet printhead is operated with an ink that is different than the one that it was initially characterized with, it may be necessary to adjust the First Catch Voltage to account for differences in ink properties. For such cases, it may be desirable to shift up or down the first catch voltage relative to the LAC voltage for the printhead. A simple multiplying factor applied to the LAC voltage might be used in such circumstances. In other cases, it may be better to define the First Catch Voltage (FCV) as FCV=LAC+(OPVolt−LAC)*m, where m is a scaling factor. Many other algorithms might be employed in which the First Catch Voltage is determined, at least in part, from the previously measured Lowest All Catch Voltage for that printhead.

While the embodiment described above stored the LAC voltage for use by the printer controller in determining the First Catch Voltage, it will be obvious to those skilled in the art that various methods can be used, in accordance with the present invention. For example, one can instead determine the First Catch Voltage from the LAC voltage and then store that value for use by the controller during the startup sequence.

For clarity, the present invention has been described with reference to an embodiment wherein the ICV is greater than the operating voltage, which is greater than the lowest all catch voltage. This is valid for printers that employ positive charge voltages applied to the charging electrodes, but not for printers that utilize negative charge voltages. It should be noted, however, that the present invention applies to both positive and negative charging voltages, and the various charge voltage conditions, such as ICV, operating voltage, and lowest all catch voltage, can be applied to both charging polarity conditions. In accordance with the present invention, the terms can be defined as voltage magnitudes.

Having described the invention in detail and by reference to the preferred embodiment thereof, it will be apparent that other modifications and variations are possible without departing from the scope of the invention defined in the appended claims.

What is claimed is:

1. A method for starting a continuous inkjet printer, the method comprising the steps of:

determining a lowest all catch voltage at which all ink drops are deflected into catch;

storing a value corresponding to the lowest all catch voltage, said stored value accessible to controller means of the continuous inkjet printer;

using the stored value to define a first charge potential;

applying the first charge potential as a charge plate voltage when initially starting up the continuous inkjet printer; and changing the charge plate voltage from the first charge potential to an operating voltage for printing.

2. A method as claimed in claim 1 wherein each charge voltage condition depends on spacing between charging electrodes and inkjets, with smaller spacings yielding smaller voltages.

3. A method as claimed in claim 1 wherein the first charge potential is less than the operating voltage.

4. A method as claimed in claim 1 wherein the first charge potential is greater than or equal to the lowest all catch voltage.

5. A method as claimed in claim 1 wherein the first charge potential is not approximated as a fixed voltage shift down from the operating voltage.

6. A method as claimed in claim 1 further comprising the step of determining an operating voltage condition during printhead assembly or during regular operation of the printhead.

7. A method as claimed in claim 6 further comprising the step of storing the operating voltage condition in memory, said stored value accessible to controller means of the continuous inkjet printer.

8. A method as claimed in claim 1 wherein the step of changing the charge plate voltage comprises the step of increasing the charge plate voltage from the first catch potential to the operating voltage in one or more increasing voltage increments.

9. A method as claimed in claim 1 wherein the first charge potential comprises a positive voltage.

10. A method as claimed in claim 1 wherein the first charge potential comprises a negative voltage.

11. A startup system for a continuous inkjet printer, method:

means for determining a lowest all catch voltage at which all ink drops are deflected into catch;

means for storing a value corresponding to the lowest all catch voltage, said stored value accessible to controller means of the continuous inkjet printer;

a first charge potential defined by the stored value;

means for applying the first charge potential as a charge plate voltage when initially starting up the continuous inkjet printer; and an operating voltage derived by changing the charge plate voltage from the first charge potential to the operating voltage for printing.

12. A startup system as claimed in claim 11 wherein each charge voltage condition depends on spacing between charging electrodes and inkjets, with smaller spacings yielding smaller voltages.

13. A startup system as claimed in claim 11 wherein the first charge potential is less than the operating voltage.

14. A startup system as claimed in claim 11 wherein the first charge potential is greater than or equal to the lowest all catch voltage.

15. A startup system as claimed in claim 11 wherein the first charge potential is not approximated as a fixed voltage shift down from the operating voltage.

16. A startup system as claimed in claim 11 further comprising an operating voltage condition determined during printhead assembly or during regular operation of the printhead.

17. A startup system as claimed in claim 16 further comprising means for storing the operating voltage condition in memory, said stored value accessible to controller means of the continuous inkjet printer.

18. A startup system as claimed in claim 11 wherein the operating voltage is achieved by increasing the charge plate voltage from the first catch potential to the operating voltage in one or more increasing voltage increments.

19. A startup system as claimed in claim 11 wherein the first charge potential comprises a positive voltage.

20. A startup system as claimed in claim 11 wherein the first charge potential comprises a negative voltage.

* * * * *